US010625515B2

(12) United States Patent
Tanaka et al.

(10) Patent No.: US 10,625,515 B2
(45) Date of Patent: Apr. 21, 2020

(54) FUSER INCLUDING ENDLESS BELT AND PRESSURE ROLLER HAVING POROUS LAYER IMPREGNATED WITH LUBRICATING AGENT

(71) Applicant: Brother Kogyo Kabushiki Kaisha, Nagoya-shi, Aichi-ken (JP)

(72) Inventors: Tokifumi Tanaka, Komaki (JP); Hiroshi Handa, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 65 days.

(21) Appl. No.: 15/903,124

(22) Filed: Feb. 23, 2018

(65) Prior Publication Data

US 2018/0244072 A1 Aug. 30, 2018

(30) Foreign Application Priority Data

Feb. 24, 2017 (JP) ..... 2017-033003
Feb. 24, 2017 (JP) ..... 2017-033004

(51) Int. Cl.

| | |
|---|---|
| ***B41J 2/22*** | (2006.01) |
| ***B41J 11/00*** | (2006.01) |
| ***B41J 13/03*** | (2006.01) |
| ***B41J 2/44*** | (2006.01) |
| ***G03G 15/20*** | (2006.01) |

(52) U.S. Cl.

CPC ..... *B41J 2/22* (2013.01); *B41J 2/442* (2013.01); *B41J 11/002* (2013.01); *B41J 13/03* (2013.01); *G03G 15/206* (2013.01); *G03G 15/2053* (2013.01)

(58) Field of Classification Search

CPC ... B41J 2/22; B41J 11/002; B41J 13/03; B41J 2/442; G03G 15/206; G03G 15/2053

See application file for complete search history.

(56) References Cited

U.S. PATENT DOCUMENTS

| | | | | |
|---|---|---|---|---|
| 7,546,078 | B2 | 6/2009 | Okuda et al. | |
| 2007/0059064 | A1* | 3/2007 | Okuda | G03G 15/206 399/329 |
| 2009/0035034 | A1* | 2/2009 | Nagase | G03G 15/2025 399/329 |
| 2012/0076556 | A1* | 3/2012 | Komuro | G03G 15/2025 399/329 |
| 2014/0119787 | A1* | 5/2014 | Hasegawa | G03G 15/2053 399/329 |

FOREIGN PATENT DOCUMENTS

| | | | |
|---|---|---|---|
| JP | 2000-267356 | A | 9/2000 |
| JP | 2005-055470 | A | 3/2005 |
| JP | 2006-133399 | A | 5/2006 |
| JP | 2006-251620 | A | 9/2006 |
| JP | 2007-079067 | A | 3/2007 |
| JP | 2008-134354 | A | 6/2008 |

* cited by examiner

*Primary Examiner* — Henok D Legesse
(74) *Attorney, Agent, or Firm* — Banner & Witcoff, Ltd.

(57) ABSTRACT

There is provided a fuser including: an endless belt; a contacting member contacting an outer peripheral surface of the endless belt; a pressure roller contacting an inner peripheral surface of the endless belt and sandwiching the endless belt together with the contacting member; and a sliding contact member making sliding contact with the inner peripheral surface of the endless belt. The pressure roller includes a first porous layer impregnated with a lubricating agent, in a place contacting the inner peripheral surface of the endless belt.

21 Claims, 8 Drawing Sheets

FUSER INCLUDING ENDLESS BELT AND PRESSURE ROLLER HAVING POROUS LAYER IMPREGNATED WITH LUBRICATING AGENT

CROSS REFERENCE TO RELATED APPLICATION

The present application claims priority from Japanese Patent Applications No. 2017-033003, filed on Feb. 24, 2017 and No. 2017-033004, filed on Feb. 24, 2017, the disclosure of which is incorporated herein by reference in its entirety.

BACKGROUND

Field of the Invention

The present teaching relates to a fuser including an endless belt, a contacting member contacting an outer peripheral surface of the endless belt, a rotating member contacting an inner peripheral surface of the endless belt and sandwiching the endless belt together with the contacting member, and a sliding-contact member making sliding contact with the inner peripheral surface of the endless belt.

Description of the Related Art

Regarding a fuser of an image forming apparatus, there is known a pressure belt system in which an endless belt is sandwiched between contacting members such as a heating member or a pressure member, whereby the contacting members are rotated.

As such a pressure belt system fuser, there is known, for example, a configuration including: an endless belt; a heating roller that contacts an outer peripheral surface of the belt; a pressure roller that contacts an inner peripheral surface of the belt and sandwiches the belt between itself and the heating roller; a pressure pad that makes sliding contact with the inner peripheral surface of the belt and presses the belt against the heating roller; and an oil applying roller that applies a lubricating agent to the inner peripheral surface of the belt in order to improve sliding between the inner peripheral surface of the belt and the pressure pad.

SUMMARY

According to an aspect of the present teaching, there is provided a fuser including: an endless belt; an contacting member contacting an outer peripheral surface of the endless belt; a pressure roller contacting an inner peripheral surface of the endless belt and sandwiching the endless belt together with the contacting member; and a sliding-contact member making sliding contact with the inner peripheral surface of the endless belt.

The pressure roller includes a first porous layer impregnated with a lubricating agent, in a place contacting the inner peripheral surface of the endless belt.

DESCRIPTION OF THE EMBODIMENTS

First Embodiment

Embodiments of the present teaching will be described in detail with appropriate reference to the drawings.

Directions in the description below will be described by directions depicted in FIG. 1. That is, regarding FIG. 1, a right side when facing the paper surface and a left side when facing the paper surface are respectively assumed to be a "far side" and a "near side", and a far side when facing the paper surface and a near side when facing the paper surface are respectively assumed to be a "left side" and a "right side". Moreover, an up-down direction when facing the paper surface is assumed to be an "up-down direction".

Figure 1:
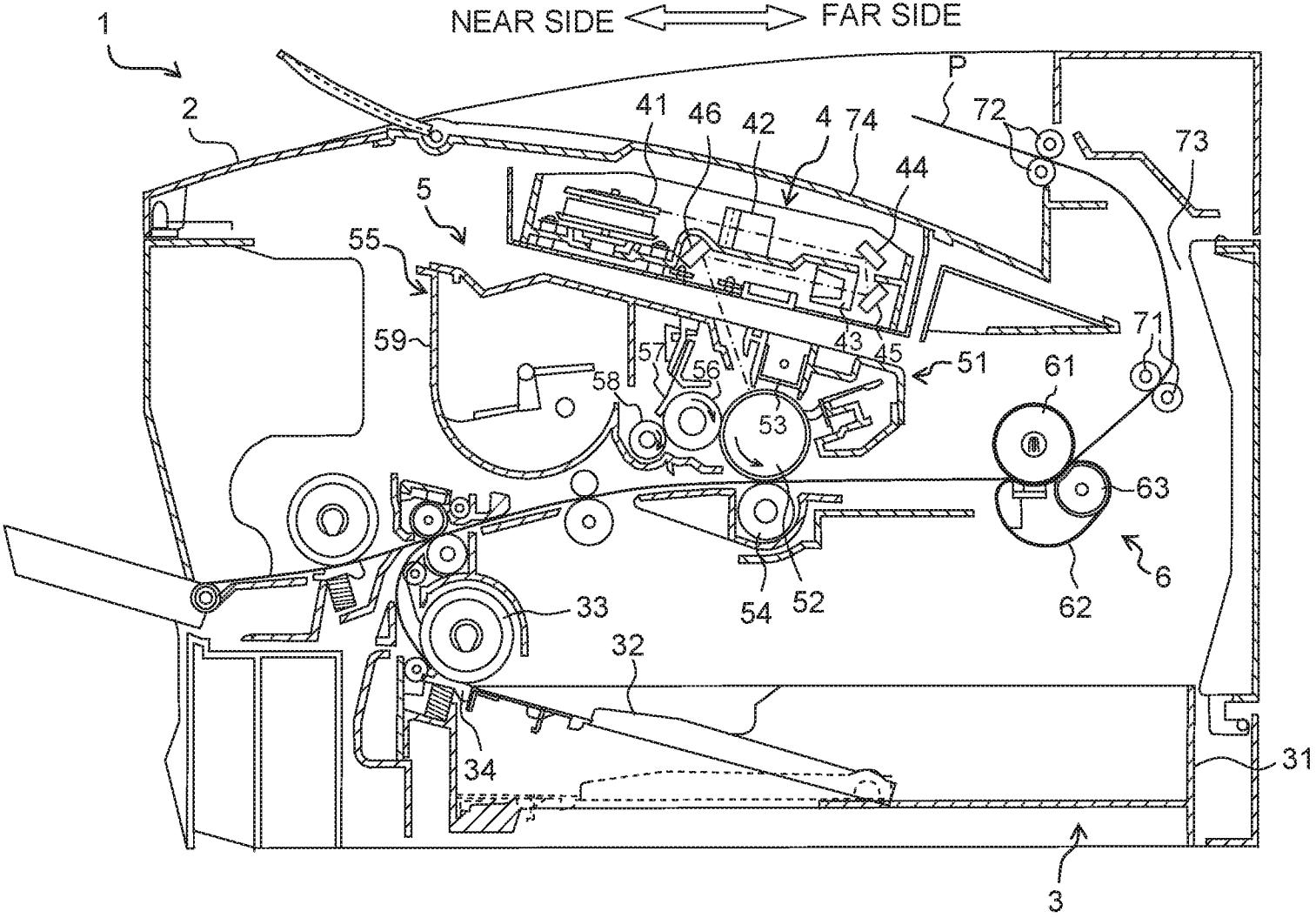
FIG. 1 is a cross-sectional view showing an overall configuration of a laser printer as an example of an image forming apparatus.

As depicted in FIG. 1, a laser printer 1 mainly includes: a paper feeding section 3 for feeding to inside a main body casing 2 a sheet P as a recording medium; an exposure apparatus 4; a processing cartridge 5 that transfers a toner image (a developer image) onto the sheet P; and a fuser 6 that thermally fuses the toner image onto the sheet P.

In the paper feeding section 3, the sheet P in a paper feeding tray 31 is drawn to a paper feeding roller 33 side by a sheet pressing plate 32 and sent out by the paper feeding roller 33 and a paper feeding pad 34 to be conveyed one at a time to the later-mentioned processing cartridge 5.

The exposure apparatus 4 is provided in an upper section of the main body casing 2 and mainly includes: a laser light-emitting section (not illustrated); a rotary-driven polygon mirror 41; lenses 42, 43; and reflecting mirrors 44, 45, 46.

The processing cartridge 5 is provided below the exposure apparatus 4 and is structured installed detachably with respect to the main body casing 2. This processing cartridge 5 includes a hollow cartridge frame 51 configuring an outer frame. The processing cartridge 5 further includes the following on an inside of the cartridge frame 51, namely: a photosensitive drum 52; a scorotron type charger 53; a transfer roller 54; and a developing cartridge 55.

The developing cartridge 55 is installed detachably with respect to the cartridge frame 51 and includes: a developing roller 56; a layer thickness regulating blade 57: a supplying roller 58; and a toner housing section 59.

The photosensitive drum 52 is rotatably supported by the cartridge frame 51. This photosensitive drum 52 has its drum main body grounded and has its surface portion formed by a positive charge type photosensitive layer.

The transfer roller 54 is rotatably supported by the cartridge frame 51, below the photosensitive drum 52, and is disposed so as to contact the photosensitive drum 52 in a manner opposing the photosensitive drum 52. This transfer roller 54 is applied with a transfer bias during transfer.

In the processing cartridge 5 configured in this way, a surface of the photosensitive drum 52, after having been uniformly positively charged by the scorotron type charger 53, is exposed by a high speed scan of a laser beam from the exposure apparatus 4. As a result, a potential of an exposed portion lowers, whereby an electrostatic latent image based on image data is formed.

Next, rotation of the developing roller 56 results in a toner carried on the developing roller 56 being supplied to the electrostatic latent image formed on the surface of the photosensitive drum 52, when the photosensitive drum 52 and the developing roller 56 contact opposing each other. By the toner being selectively carried on the surface of the photosensitive drum 52 in this way, the electrostatic latent image is turned into a visible image, and the toner image is formed by reversal development.

Then, the photosensitive drum 52 and the transfer roller 54 rotate so as to convey the sheet P sandwiching it between them and the sheet P is conveyed between the photosensitive drum 52 and the transfer roller 54, whereby the toner image carried on the surface of the photosensitive drum 52 is transferred onto the sheet P.

The fuser 6 is provided on the far side (a downstream side in a conveyance direction of the sheet P) of the processing cartridge 5, and mainly includes: a heating roller 61; an endless belt 62; and a pressure roller 63 pressed against the heating roller 61. In addition, paper discharge rollers 71, 72 and a paper discharge path 73 for discharging to outside of the main body casing 2 the sheet P conveyed from the fuser 6 are provided on the downstream side in the conveyance direction of the sheet P of the fuser 6.

In the fuser 6 configured in this way, the toner image transferred onto the sheet P is thermally fused while the sheet P is passing between the heating roller 61 and the belt 62 hung on the pressure roller 63. Subsequently, the sheet P is conveyed in the paper discharge path 73 by the paper discharge rollers 71, and discharged from the paper discharge path 73 onto a paper discharge tray 74 by the paper discharge rollers 72.

An outline of the fuser 6 and details of the pressure roller 63 will be described below with reference to FIGS. 2 and 3.

Figure 2:
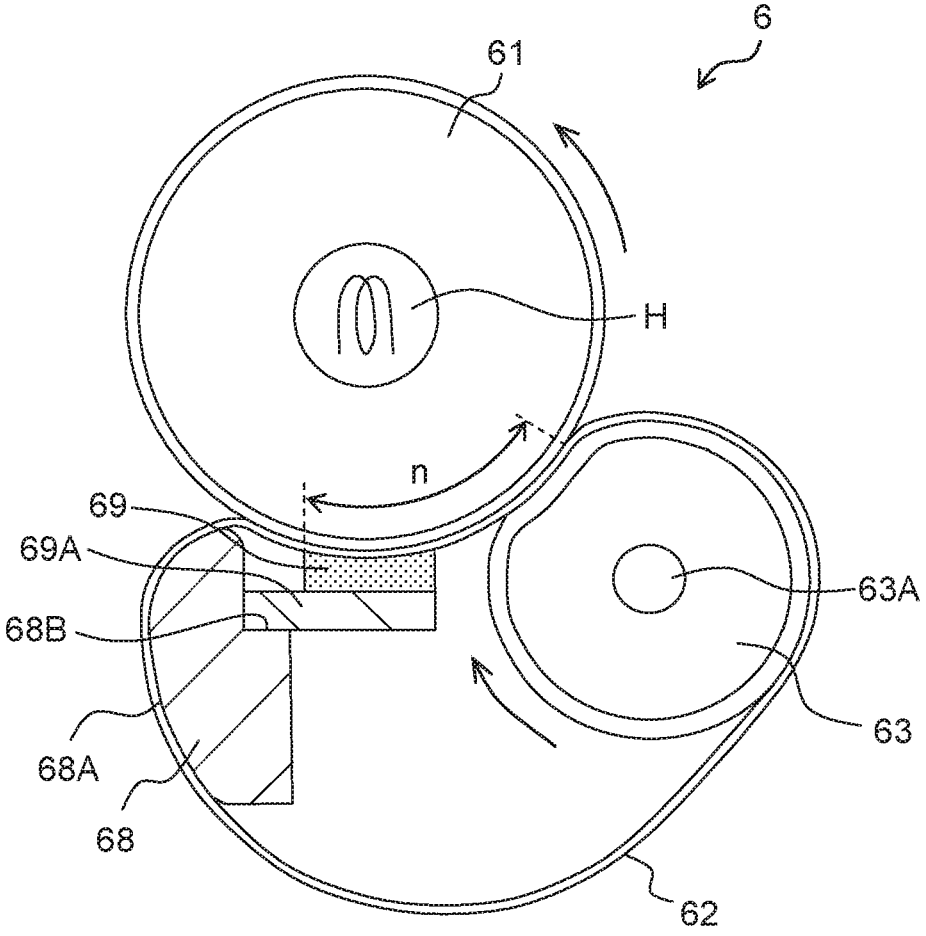
FIG. 2 is a cross-sectional view showing a configuration of a fuser according to a first embodiment of the present teaching.

As depicted in FIG. 2, the fuser 6 includes: the heating roller 61 as an example of an contacting member; the endless belt 62; the pressure roller 63 as an example of a rotating member that contacts an inner peripheral surface of the belt 62 and sandwiches the belt 62 between itself and the heating roller 61; and a belt guide 68 and pressure pad 69 as an example of a sliding-contact member that make sliding contact with the inner peripheral surface of the belt 62.

The heating roller 61 is formed in a cylindrical shape and is configured so that a surface of the heating roller 61 is heated to a fusing temperature by a heat source H such as a halogen heater provided on an inside of the heating roller 61. Moreover, both end sections projecting outwardly in an axial direction of the heating roller 61 are rotatably supported by a frame (not illustrated).

The heating roller 61 is rotary-driven by transmission thereto of drive power from a drive source (not illustrated) provided in the main body casing 2 and contacts an outer peripheral surface of the belt 62, thereby causing the belt 62 to rotate by being drawn round by the heating roller 61.

The belt 62 is wound around the pressure roller 63, the belt guide 68, and the pressure pad 69. The belt 62 rotates by being drawn round by the heating roller 61 and the pressure roller 63 while making sliding contact with the belt guide 68 and the pressure pad 69.

The belt 62 may be formed by, for example, a heat-resistant resin such as a polyimide (PI) configured in film form or a nickel electroformed film, a stainless steel electroformed film, and so on, being processed into an endless form.

The belt guide 68 is a member, extending along the axial direction of the heating roller 61, that guides the inner peripheral surface of the rotating belt 62 and supports the pressure pad 69 via a supporting section 69A.

The belt guide 68 is disposed on an opposite side to the pressure roller 63 with respect to the pressure pad 69, and guides the belt 62 by making sliding contact with the inner peripheral surface of the belt 62.

The belt guide 68 is configured by a material having a small coefficient of friction with the inner peripheral surface of the belt 62 and has: an outer peripheral section 68A of curved shape that makes sliding contact with the inner peripheral surface of the belt 62; and a fixing surface 68B by which the supporting section 69A supporting the pressure pad 69 is fixed.

The pressure pad 69 sandwiches the belt 62 between itself and the heating roller 61 by pressing the belt 62 against the heating roller 61. The pressure pad 69 is a member for achieving speeding up of thermal fusing speed by enlarging a nip width n together with the pressure roller 63 and increasing a contact area of the sheet P with the heating roller 61.

The pressure pad 69 extends along the axial direction of the heating roller 61 and is fixed to a surface of the supporting section 69A. The pressure pad 69 is configured by an elastic material having a small coefficient of friction with the inner peripheral surface of the belt 62.

The pressure roller 63 contacts the inner peripheral surface of the belt 62 and presses the belt 62 against the heating roller 61, thereby sandwiching the belt 62 between itself and the heating roller 61. When the heating roller 61 is rotary-driven, the pressure roller 63 rotates by being drawn round together with the belt 62.

Figure 3:
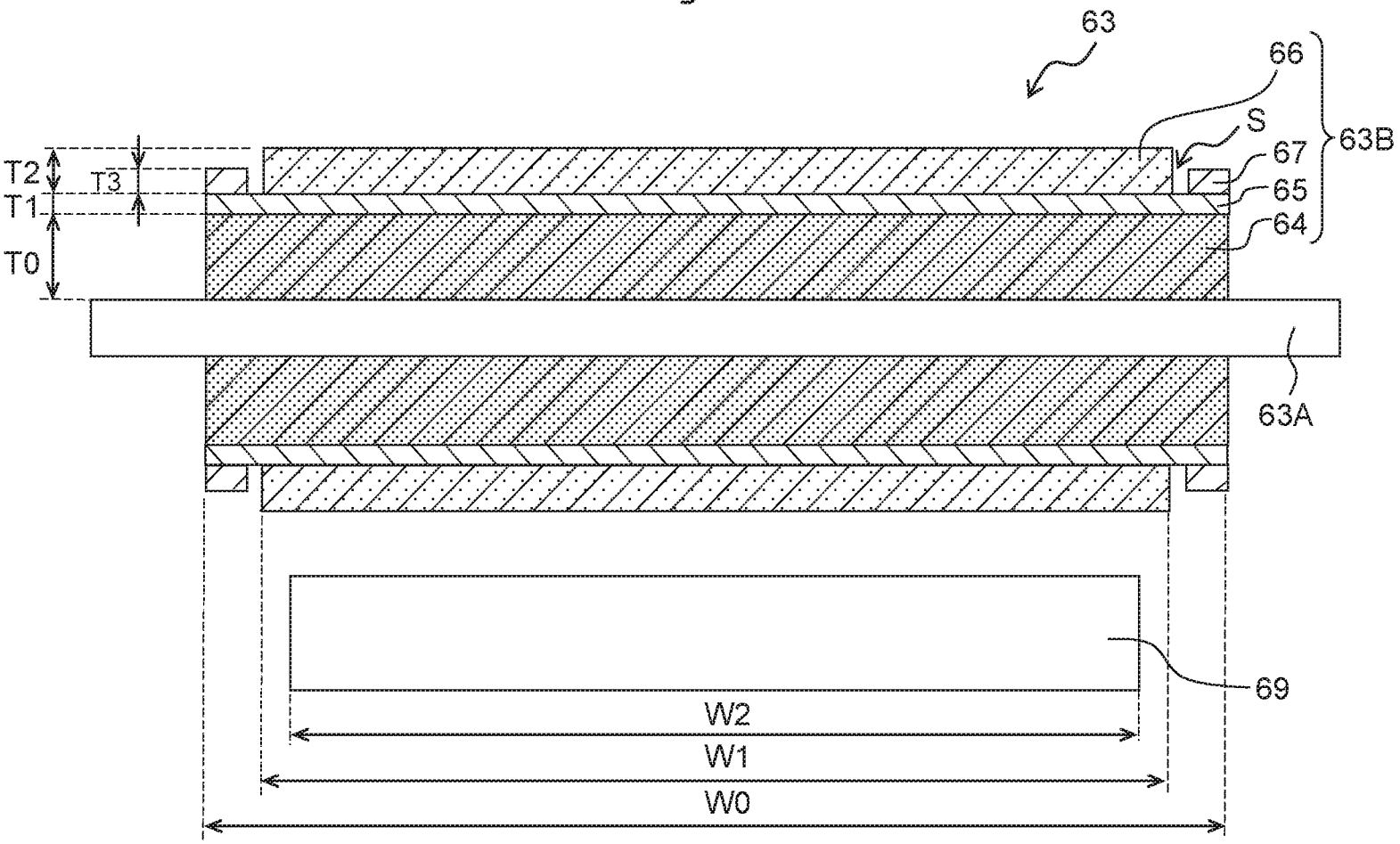
FIG. 3 is a cross-sectional view showing a configuration of a pressure roller and a positional relationship of the pressure roller with respect to a pressure pad, in the first embodiment of the present teaching.

As depicted in FIG. 3, the pressure roller 63 includes: a cored bar 63A configured from a rod shaped member made of a metal that configures a rotating shaft; and a roller section 63B that covers a periphery of the cored bar 63A.

Both end sections of the cored bar 63A project outwardly in an axial direction from both ends of the roller section 63B and are rotatably supported by a frame (not illustrated). Note that the rotating shaft, instead of being configured by the cored bar 63A penetrating the roller section 63B, may be configured by two circular columnar projections projecting from both ends in the axial direction of the roller section 63B without penetrating the roller section 63B.

The roller section 63B has its outer peripheral surface contacting the inner peripheral surface of the belt 62, and in an axial direction of the pressure roller 63 (hereafter, called simply an "axial direction"), has a width W0 less than or equal to a width of the belt 62.

The roller section 63B has: an elastic layer 64 that covers a periphery of the cored bar 63A; a nonporous layer 65 (a first nonporous layer) which is provided on an outer peripheral surface of the elastic layer 64; and a porous layer 66 that is provided on an outer peripheral surface of the nonporous layer 65 and contacts the inner peripheral surface of the belt 62. In other words, in a radial direction of the pressure roller 63, the nonporous layer 65 is provided between the porous layer 66 and the elastic layer 64.

Moreover, a nonporous layer 67 (second nonporous layer) is provided on both sides of the porous layer 66, in the axial direction, on the outer peripheral surface of the nonporous layer 65.

The elastic layer 64 is a porous layer, and is configured from an elastic material such as silicone rubber, for example. The elastic layer 64 has a thickness T0 of several millimeters, and is formed more thickly than thicknesses of the later-mentioned nonporous layer 65 and porous layer 66. Moreover, the elastic layer 64 is provided over an entire width of the roller section 63B, in the axial direction.

The nonporous layer 65 is configured from a material that degrades by a lubricating agent with more difficulty than the elastic layer 64 does, and is provided over an entire width of the elastic layer 64.

The nonporous layer 65 is thinner than the thickness T0 of the elastic layer 64 and has a thickness T1 of not more than several micrometers. Moreover, the thickness T1 of the nonporous layer 65 is configured thinner than a thickness of the later-mentioned porous layer 66.

The nonporous layer 65 is configured from a heat-resistant resin configured from a single material or plurality of materials of, for example, a PEEK (polyetheretherketone) resin, a PPS (polyphenylene sulfide) resin, a silicone resin, a fluorine-based resin (PTFE, PFA, FEP, EEFT), an imide-based resin (polyimide, polyamide imide, polyether imide), and a PBI (polybenzimidazole) resin.

The nonporous layer 65 is formed by coating the above-mentioned resin material on the outer peripheral surface of the elastic layer 64, and then performing firing or natural drying. Alternatively, the nonporous layer 65 may be manufactured by forming in advance a tube of the nonporous layer 65 by the above-mentioned resin material, injecting an elastic material into an inside of this tube in a state that the cored bar 63A has been inserted into the inside of the tube, and forming the elastic layer 64 on an inner peripheral surface of the nonporous layer 65.

The porous layer 66 is a layer for applying the lubricating agent to the inner peripheral surface of the belt 62 in order to reduce sliding resistance between the belt guide 68 and pressure pad 69 and the belt 62.

Specifically, the porous layer 66 is configured by impregnating with the lubricating agent a porous layer of a continuous cell structure having a thickness of several micrometers provided in a central section in the axial direction of the roller section 63B, and, moreover, the porous layer 66 applies the lubricating agent to the inner peripheral surface of the belt 62 by being squeezed by receiving pressure between itself and the heating roller 61 when the belt 62 rotates by contacting the nonporous layer 67. Therefore, the porous layer 66 is formed so that, in a state where pressure is not being applied between the pressure roller 63 and the heating roller 61, at least part of a surface of the porous layer 66 is positioned more outwardly in a radial direction of the pressure roller 63 than a surface of the nonporous layer 67. In detail, a thickness T2 of the porous layer 66 is formed more thickly than a thickness of the later-mentioned nonporous layer 67.

Note that a "state where pressure is not being applied between the pressure roller 63 and the heating roller 61" means a state where an entire surface of the pressure roller 63 is not being squeezed, before installation of the pressure roller 63. Moreover, it means a state where, as depicted in FIG. 2, even after the pressure roller 63 has been installed, a portion not contacting the inner peripheral surface of the belt 62, of the entire surface of the pressure roller 63 is not being squeezed.

The porous layer 66 has a width W1 smaller than the width W0 of the nonporous layer 65, in the axial direction, and is disposed with both ends of the nonporous layer 65 projecting more outwardly than both ends of the porous layer 66.

Moreover, the width W1 of the porous layer 66 is configured to be equal to or broader than a width W2 of the pressure pad 69, and the porous layer 66 is disposed with both ends of the porous layer 66 projecting more outwardly than both ends of the pressure pad 69.

Note that the width W1 of the porous layer 66 is configured to be not less than a width of the sheet P of minimum size usable in the laser printer 1.

The porous layer 66 is configured from a heat-resistant resin configured from a single material or plurality of materials of, for example, a PEEK (polyetheretherketone) resin, a PPS (polyphenylene sulfide) resin, a silicone resin, a fluorine-based resin (PTFE, PFA, FEP, EEFT), an imide-based resin (polyimide, polyamide imide, polyether imide), and a PBI (polybenzimidazole) resin.

Moreover, the porous layer 66 has a plurality of pores each of whose cell diameter is not less than 0.1 μm and not more than several tens of micrometers, for being impregnated with the lubricating agent. The plurality of pores are dispersed substantially evenly in an entire layer of the porous layer 66.

The porous layer 66 is formed by, for example, coating the outer peripheral surface of the nonporous layer 65 by a solution including the above-mentioned resin material, and performing firing or natural drying to evaporate a solvent in the solution, thereby materializing the porous layer, and then impregnating the porous layer with the lubricating agent.

The nonporous layer 67 is provided on the outer peripheral surface of the nonporous layer 65, and is disposed on an outer side of the porous layer 66 in the axial direction. In detail, a slit S is provided from both ends of the porous layer 66 whereby two nonporous layers 67 are provided in both end sections in the axial direction of the roller section 63B. The nonporous layer 67 is a layer having a larger coefficient of friction with the inner peripheral surface of the belt 62 than the porous layer 66 impregnated with the lubricating agent does. Moreover, the nonporous layer 67 is configured so as to be impregnated by the lubricating agent with more difficulty than the porous layer 66 is.

The nonporous layer 67 is configured from a material that degrades by a lubricating agent with more difficulty than the elastic layer 64 does. In detail, the nonporous layer 67 is configured by a heat-resistant resin appropriately selected from among resin materials similar to those of the nonporous layer 65, has a large coefficient of friction with the inner peripheral surface of the belt 62, and has oil repellency for sealing the lubricating agent. Note that the nonporous layer 67 and the nonporous layer 65 may be formed integrally by the same material, but the nonporous layer 67 and the elastic layer 64 are never formed integrally.

Moreover, a thickness T3 of the nonporous layer 67 is thinner than the thickness T2 of the porous layer 66, and is set so as to be equal to the thickness of the porous layer 66 squeezed by receiving pressure from the belt 62 when the belt 62 rotates sandwiched between the heating roller 61 and the pressure roller 63.

A publicly known lubricating agent may be used as the lubricating agent. However, the lubricating agent is determined considering a combination of the lubricating agent with the heat-resistant resins configuring the nonporous layer 65, the porous layer 66, and the nonporous layer 67.

Specifically, when the nonporous layer 65, the porous layer 66, and the nonporous layer 67 are configured from a silicone resin, a lubricating agent other than a silicone oil is used as the lubricating agent. Similarly, when the nonporous layer 65, the porous layer 66, and the nonporous layer 67 are configured from a fluorine-based resin, a lubricating agent other than a fluorine-based lubricating agent is used.

Next, operation of the fuser 6 configured as above will be described.

As depicted in FIG. 2, when the heating roller 61 contacting the outer peripheral surface of the belt 62 rotates, the belt 62 and the pressure roller 63 contacting the inner peripheral surface of the belt 62 rotate by being drawn round by the heating roller 61.

At this time, the pressure roller 63 rotates stably together with the belt 62 by a frictional force between the nonporous layers 67 provided in both end sections in the axial direction and the inner peripheral surface of the belt 62. Moreover, the porous layer 66 positioned outwardly in the radial direction of the pressure roller 63 is squeezed by pressure from the belt 62 between the pressure roller 63 and the heating roller 61, whereby the lubricating agent impregnated in the porous layer 66 is applied to the inner peripheral surface of the belt 62.

Therefore, while the belt 62 rotates stably by the nonporous layers 67, the lubricating agent can be stably applied to the inner peripheral surface of the belt 62 by the porous layer 66.

Due to the above, the following advantages can be obtained in the present embodiment.

By the porous layer 66 impregnated with the lubricating agent being included in the pressure roller 63 in a place contacting the inner peripheral surface of the belt 62, it becomes unnecessary for a member for applying the lubricating agent to the inner peripheral surface of the belt 62 to be provided separately from the pressure roller 63, hence the lubricating agent can be applied to the inner peripheral surface of the belt 62 without increasing the number of components, and the sliding resistance between the belt guide 68 and pressure pad 69 and the inner peripheral surface of the belt 62 can be reduced.

Furthermore, by the nonporous layer 65 being provided between the porous layer 66 and the elastic layer 64 in the radial direction of the pressure roller 63, it can be suppressed that the lubricating agent impregnated in the porous layer 66 contacts the elastic layer 64, hence degradation of the elastic layer 64 due to the lubricating agent can be suppressed.

Since the width W0 of the nonporous layer 65 is larger than the width W1 of the porous layer 66 in the axial direction, the lubricating agent flowing into the elastic layer 64 from the porous layer 66 can be more reliably suppressed, whereby degradation of the elastic layer 64 due to the lubricating agent can be more reliably suppressed.

By the nonporous layer 67 being provided on both sides of the porous layer 66 in the axial direction, the pressure roller 63 is drawn round with the belt 62 by the nonporous layers 67 having a larger coefficient of friction with the inner peripheral surface of the belt 62 than the porous layer 66 does, hence the belt 62 can be stably rotated. Therefore, the lubricating agent can be more stably applied to the inner peripheral surface of the belt 62 compared to in a configuration where the pressure roller 63 and the belt 62 slip and are drawn round with difficulty.

In a state where pressure is not being applied between the pressure roller 63 and the heating roller 61, at least part of the surface of the porous layer 66 is positioned more outwardly in the radial direction of the pressure roller 63 than the surface of the nonporous layer 67, hence when pressure is applied between the pressure roller 63 and the heating roller 61, the porous layer 66 positioned on an outer side in the radial direction is squeezed, whereby the lubricating agent can be more reliably applied to the inner peripheral surface of the belt 62.

By the slit S being provided between the porous layer 66 and the nonporous layer 67, the slit S functions as an annular lubricating agent reservoir, and it becomes difficult for the lubricating agent flowing out outwardly in the axial direction from the porous layer 66 to leak to the surface of the nonporous layer 67.

Due to the width W1 of the porous layer 66 being greater than or equal to the width W2 of the pressure pad 69 in the axial direction, the lubricating agent can be supplied from the porous layer 66 to an entire surface of the pressure pad 69 via the inner peripheral surface of the belt 62. As a result, sliding resistance can be reduced between the inner peripheral surface of the belt 62 and the pressure pad 69.

Next, modified modes of the first embodiment will be described. As depicted in the modified modes below, the pressure roller 63 as a rotating member in the first embodiment may also be changed variously. Note that in the description below, configuring elements similar to those of the previously described embodiment will be referred to using the same symbols as those used in the previously described embodiment, and detailed descriptions thereof will be omitted.

Figure 4:
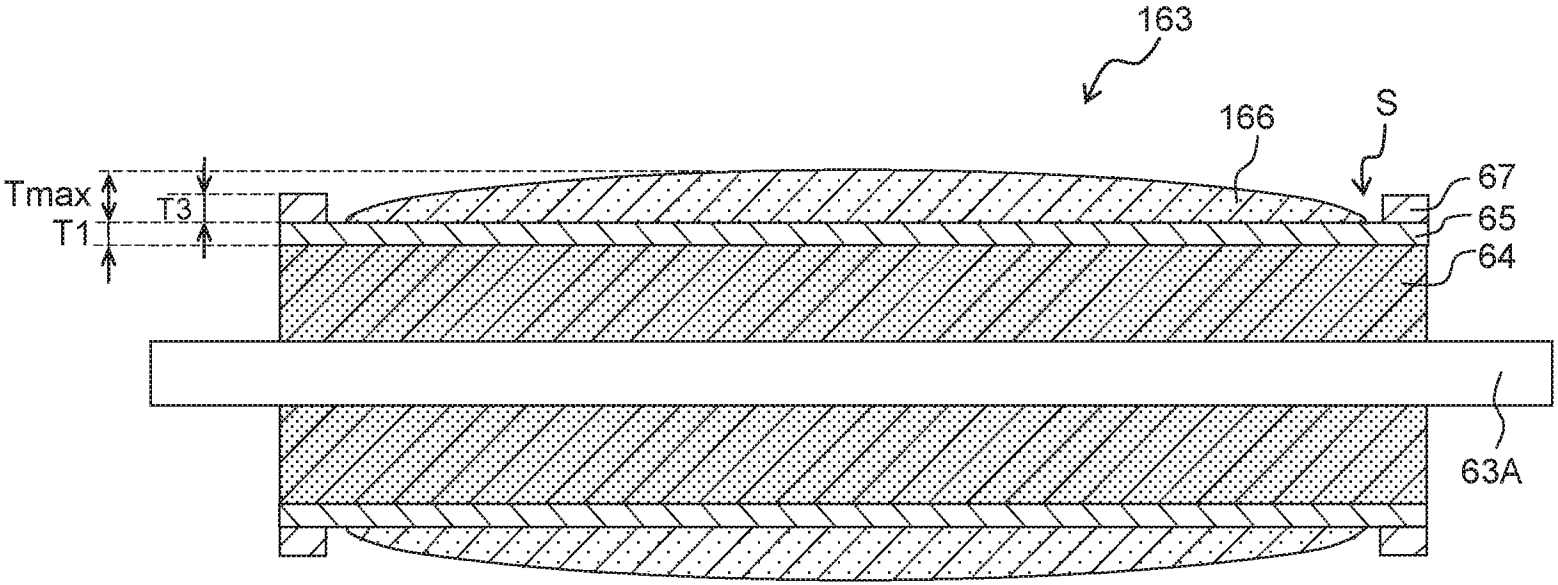
FIG. 4 is a cross-sectional view of a pressure roller according to a first modified embodiment of the first embodiment.

As depicted in FIG. 4, in a pressure roller 163 according to a first modified embodiment, a porous layer 166 has a crown shape, and the slit S is provided from both ends of the porous layer 166, whereby the two nonporous layers 67 are provided.

A central section in the axial direction of the porous layer 166 is positioned more outwardly in a radial direction of the pressure roller 163 than both end sections in the axial direction of the porous layer 166, and a thickness of the porous layer 166 gradually thins from the central section in the axial direction to the both end sections in the axial direction. Moreover, a maximum thickness $T_{max}$ in the central section in the axial direction of the porous layer 166 is configured thicker than the thickness T3 of the nonporous layer 67.

Moreover, the thickness T1 of the nonporous layer 65 is configured thinner than the maximum thickness $T_{max}$ of the porous layer 166.

When the pressure roller 163 is pressed against the heating roller 61, the pressure roller 163 can be biased to a heating roller 61 side by springs (not illustrated) provided in both end sections of the rotating shaft of the pressure roller 163, for example. In this case, it is not the case that, in an outer peripheral surface of the pressure roller 163, a biasing force acts uniformly over an entire axial direction, in fact, a biasing force acting on the central section in the axial direction is smaller than a biasing force acting on the both end sections in the axial direction.

Accordingly, by configuring the porous layer 166 in a crown shape, the lubricating agent can be favorably applied to the inner peripheral surface of the belt 62 even in the central section in the axial direction where contact pressure decreases when contact is made with the inner peripheral surface of the belt 62.

Due to the fuser according to the first modified embodiment, the central section in the axial direction of the porous layer 166 is positioned more outwardly in the radial direction of the pressure roller 163 than the both end sections in the axial direction of the porous layer 166, hence the lubricating agent can be favorably applied to the inner peripheral surface of the belt 62.

Figure 5:
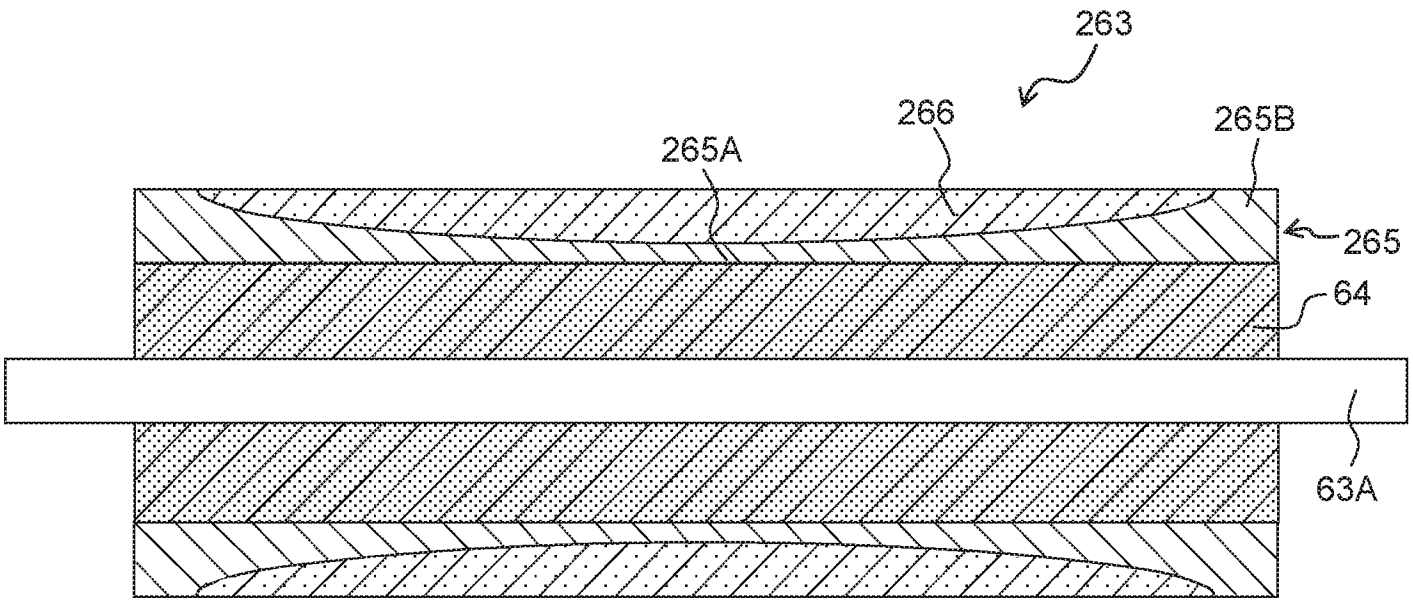
FIG. 5 is a cross-sectional view of a pressure roller according to a second modified embodiment of the first embodiment.

As depicted in FIG. 5, in a pressure roller 263 according to a second modified embodiment, a nonporous layer 265 (a first nonporous layer) provided on the outer peripheral surface of the elastic layer 64 has an inverted crown shape. In more detail, both end sections 265B in the axial direction of the nonporous layer 265 are positioned more outwardly in a radial direction of the pressure roller 263 than a central section 265A in the axial direction of the nonporous layer 265, and a thickness of the nonporous layer 265 gradually thins from the both end sections 265B to the central section 265A.

A porous layer 266 is provided between the both end sections 265B of the nonporous layer 265 on an outer peripheral surface of the nonporous layer 265, and is configured so that an outer peripheral surface of the porous layer 266 is continuous with outer peripheral surfaces of the both end sections 265B of the nonporous layer 265 to together contact the inner peripheral surface of the belt 62. A central section in the axial direction of the porous layer 266 is positioned more inwardly in the radial direction of the pressure roller 263 than the both end sections in the axial direction of the porous layer 266, and a thickness of the porous layer 266 gradually thins from the central section to the both end sections.

Moreover, the porous layer 266 is more flexible than the nonporous layer 265 and is impregnated with more of the lubricating agent in the central section in the axial direction than in the both end sections in the axial direction.

Similar advantages to the above-mentioned advantages of the fuser according to the first modified embodiment can be obtained even in the fuser according to the second modified embodiment configured in this way.

In the previously described first embodiment and each of the modified modes, it is desirable that the lubricating agent used is appropriately determined matching selection of the material of the sliding-contact member in addition to selection of the materials configuring each of the layers of the pressure roller.

For example, it is possible for the porous layer to be configured by a material configured from a fluorine-based resin (PTFE, PFA, FEP, EEFT) and for silicone oil to be used as the lubricating agent. Moreover, it is possible for the first nonporous layer, the second nonporous layer, the belt guide, and the pressure pad to be configured from a heat-resistant resin other than a silicone resin.

In the previously described pressure rollers of the first embodiment and the first modified embodiment, the slit was provided on both sides of the porous layer in the axial direction, whereby two of the second nonporous layers were disposed. However, the present teaching is not limited to such a configuration.

For example, two of the second nonporous layers may be provided contacting both ends of the porous layer.

In addition, the porous layer may be provided over an entire width of the first nonporous layer in the axial direction, without providing the second nonporous layer.

Moreover, it is possible for a plurality of porous layers to be provided in the axial direction and for the second nonporous layer to be provided between these porous layers.

In the previously described pressure rollers of the first embodiment and the first modified embodiment, the second nonporous layer was provided in both end sections in the axial direction of the roller section on the outer peripheral surface of the first nonporous layer. However, the present teaching is not limited to such a configuration.

For example, it is possible for the second nonporous layer to be provided directly on the outer peripheral surface of the elastic layer in both end sections in the axial direction of the roller section, and for the first nonporous layer and the porous layer to be provided on the outer peripheral surface of the elastic layer between these second nonporous layers.

In the previously described first modified embodiment, thicknesses of the elastic layer and the first nonporous layer were uniform in the axial direction, and the porous layer was formed in a crown shape. However, the present teaching is not limited to such a configuration, and it is also possible for the porous layer to be configured with a uniform thickness in the axial direction and for the elastic layer or the first nonporous layer to be configured in a crown shape.

In the previously described first embodiment, the first nonporous layer was provided on the outer peripheral surface of the elastic layer, and the porous layer and the second nonporous layer were provided on the outer peripheral surface of the first nonporous layer. However, an adhesive layer may be provided between each of the layers. The adhesive layer is configured by a material configured from a silicone resin, for example. Providing the adhesive layer enables durability of the pressure roller to be further improved.

Second Embodiment

Next, a second embodiment of the present teaching will be described. In the description below, configuring elements similar to those of the previously described first embodiment will be referred to using the same symbols as those used in the previously described first embodiment, and detailed descriptions thereof will be omitted.

Figure 6A:
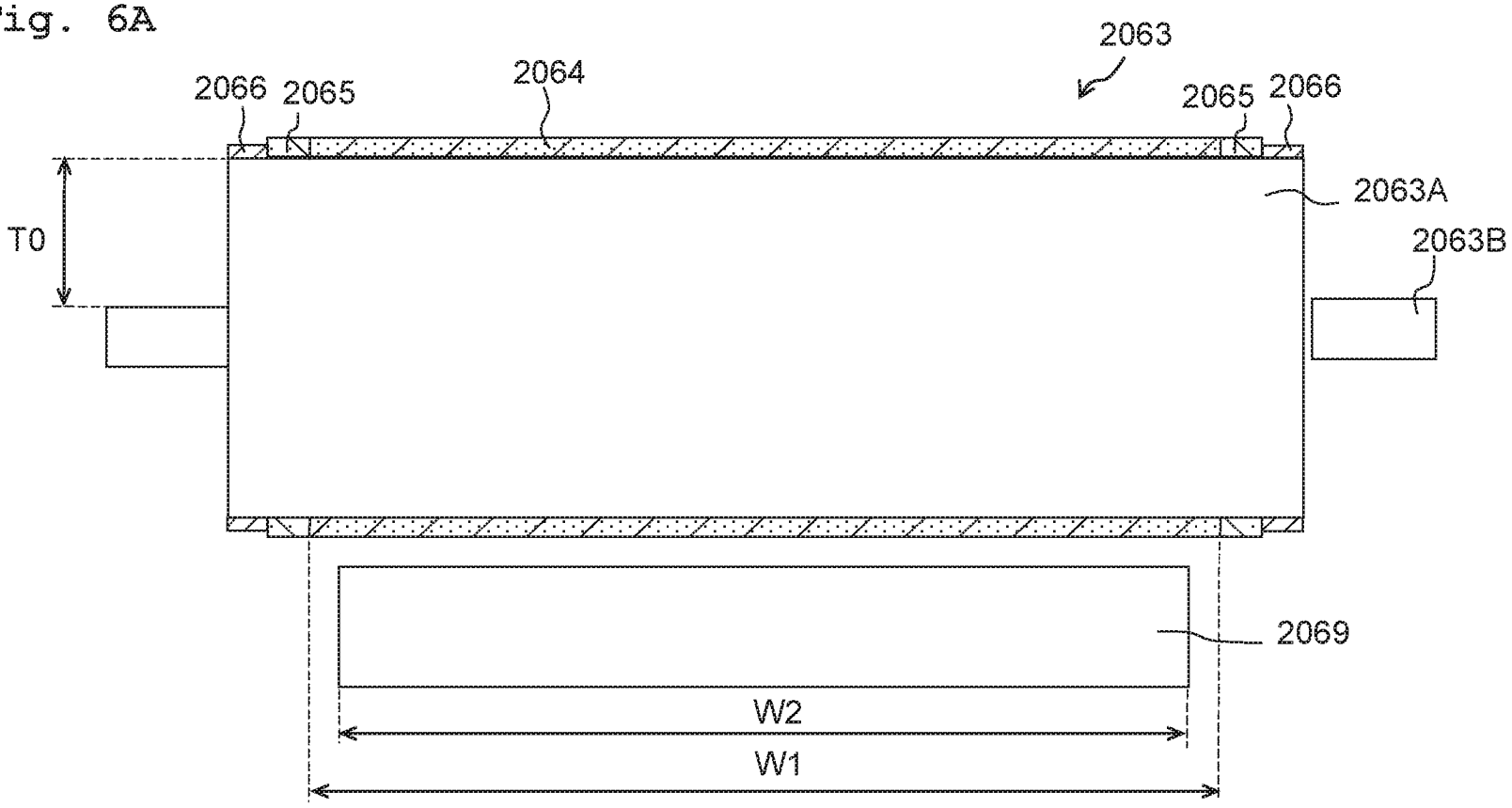
FIG. 6A is a cross-sectional view showing a configuration of a pressure roller and a positional relationship of the pressure roller with respect to a pressure pad, in a second embodiment of the present teaching.
Figure 6B:
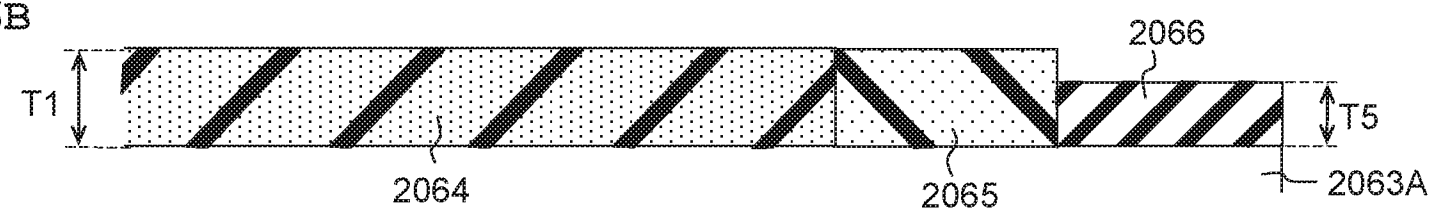
FIG. 6B is a partial enlarged view of a surface layer of the pressure roller of the second embodiment.

As depicted in FIGS. 6A and 6B, a pressure roller 2063 includes a roller section 2063A and a rotating shaft 2063B.

In detail, the roller section 2063A is configured from an elastic layer covering a periphery of the rotating shaft 2063B. Moreover, the rotating shaft 2063B is a rod shaped member made of a metal, and both end sections of the rotating shaft 2063B project outwardly in the axial direction from both ends of the roller section 2063A and are rotatably supported by a frame (not illustrated). Note that the rotating shaft 2063B may be a rod shaped member that penetrates the roller section 2063A, or may be two projections that project from both ends in the axial direction of the roller section 2063A without penetrating the roller section 2063A.

Moreover, a porous layer 2064 (first porous layer), two porous layers 2065, and two resistance layers 2066 are provided on an outer peripheral surface of the roller section 2063A, in a state of being in contact with each other, in a place contacting the inner peripheral surface of the belt 62. Note that the porous layer 2064 is an example of a first porous section, the porous layer 2065 is an example of a second porous section, and the resistance layer 2066 is an example of a resistance section.

The porous layer 2064 is a layer for applying the lubricating agent to the inner peripheral surface of the belt 62 in order to reduce sliding resistance between the belt guide 68 and pressure pad 69 and the belt 62.

Specifically, the porous layer 2064 is configured by impregnating with the lubricating agent a porous layer of a continuous cell structure having a thickness of several micrometers provided in a central section in the axial direction of the roller section 2063A, and, moreover, the porous layer 2064 applies the lubricating agent to the inner peripheral surface of the belt 62 by being squeezed by receiving pressure between itself and the heating roller 61 when the belt 62 rotates by contacting the resistance layer 2066. Therefore, the porous layer 2064 is formed so that, in a state where pressure is not being applied between the pressure roller 2063 and the heating roller 61, at least part of a surface of the porous layer 2064 is positioned more outwardly in a radial direction of the pressure roller 2063 than a surface of the resistance layer 2066. In more detail, whereas a thickness T0 of the roller section 2063A (a distance from an outer peripheral surface of the rotating shaft 2063B to the outer peripheral surface of the roller section 2063A) is uniform in the axial direction, a thickness T1 of the porous layer 2064 is formed more thickly than a thickness T5 of the resistance layer 2066.

Moreover, in an axial direction of the pressure roller 2063 (hereafter, called simply an "axial direction"), the porous layer 2064 has a width W1 of not less than a width of the sheet P of minimum size usable in the laser printer 1. Furthermore, the width W1 of the porous layer 2064 is configured to be equal to or broader than the width W2 of the pressure pad 69, and the porous layer 2064 is disposed with both ends of the porous layer 2064 projecting more outwardly than both ends of the pressure pad 69.

The porous layer 2064 is configured from a heat-resistant resin configured from a single material or plurality of materials of, for example, a PEEK (polyetheretherketone) resin, a PPS (polyphenylene sulfide) resin, a silicone resin, a fluorine-based resin (PTFE, PFA, FEP, EEFT), an imide-based resin (polyimide, polyamide imide, polyether imide), and a PBI (polybenzimidazole) resin.

Moreover, the porous layer 2064 has a plurality of pores each of whose cell diameter is not less than 0.1 μm and not more than several tens of micrometers, for being impregnated with the lubricating agent. The plurality of pores are dispersed substantially evenly in an entire layer of the porous layer 2064.

The porous layer 2064 is formed by, for example, coating the roller section 2063A by a solution including the above-mentioned resin material, and performing firing or natural drying to evaporate a solvent in the solution, thereby materializing the porous layer, and then impregnating the porous layer with the lubricating agent.

A publicly known lubricating agent may be used as the lubricating agent. However, the lubricating agent is determined considering a combination of the lubricating agent with the heat-resistant resin configuring the porous layer 2064.

Specifically, when the porous layer 2064 is configured from a silicone resin, a lubricating agent other than a silicone oil is used as the lubricating agent. Similarly, when the porous layer 2064 is configured from a fluorine-based resin, a lubricating agent other than a fluorine-based lubricating agent is used.

The porous layer 2065 is provided on both sides of the porous layer 2064 in the axial direction, and is a layer for absorbing the lubricating agent flowing outwardly in the axial direction from the porous layer 2064.

The porous layer 2065, similarly to the porous layer 2064, is a porous layer of a continuous cell structure, and has a thickness substantially equal to the thickness T1 of the porous layer 2064. Two of the porous layers 2065 are provided on outer sides of the porous layer 2064 in the axial direction.

The porous layer 2065 is configured by appropriately selecting from similar resin materials to those of the porous layer 2064, but is not impregnated with the lubricating agent. Moreover, a proportion of volume occupied by pores (a porosity) of the layer overall is larger for the porous layer 2065 than for the porous layer 2064.

Note that magnitude of the porosity in the porous layer can be changed by appropriately adjusting a cell diameter of the pores and/or the number of pores.

The resistance layer 2066 is disposed on an outer side of the porous layer 2065 in the axial direction, in detail, is provided in both end sections in the axial direction of the roller section 2063A. The resistance layer 2066 is a layer having a larger coefficient of friction with the inner peripheral surface of the belt 62 than the porous layer 2064 impregnated with the lubricating agent does. Moreover, the resistance layer 2066 is configured so as to be impregnated by the lubricating agent with more difficulty than the porous layer 2064 is.

The resistance layer 2066 is a nonporous layer configured from silicone rubber, for example, has a large coefficient of friction with the inner peripheral surface of the belt 62, and has oil repellency for sealing the lubricating agent.

Due to the above, the following advantages can be obtained in the present embodiment.

By the porous layer 2064 impregnated with the lubricating agent being included in the pressure roller 2063 in a place contacting the inner peripheral surface of the belt 62, it becomes unnecessary for a member for applying the lubricating agent to the inner peripheral surface of the belt 62 to be provided separately from the pressure roller 2063, hence the lubricating agent can be applied to the inner peripheral surface of the belt 62 without increasing the number of components, and the sliding resistance between the belt guide 68 and pressure pad 69 and the inner peripheral surface of the belt 62 can be reduced.

By the resistance layer 2066 that has a larger coefficient of friction with the inner peripheral surface of the belt 62 than the porous layer 2064 does being included in the pressure roller 2063 in a place contacting the inner peripheral surface of the belt 62, the pressure roller 2063 can be drawn round with the belt 62 and the belt 62 can be stably rotated, hence the lubricating agent can be more stably applied to the inner peripheral surface of the belt 62 compared to in a configuration where the pressure roller 2063 and the belt 62 slip and are drawn round with difficulty.

In a state where pressure is not being applied between the pressure roller 2063 and the heating roller 61, at least part of the surface of the porous layer 2064 is positioned more outwardly in the radial direction of the pressure roller 2063 than the surface of the resistance layer 2066, hence when pressure is applied between the pressure roller 2063 and the heating roller 61, the porous layer 2064 positioned on an outer side in the radial direction is squeezed, whereby the lubricating agent can be more reliably applied to the inner peripheral surface of the belt 62.

By the resistance layer 2066 being provided in the both end sections of the pressure roller 2063 and the porous layer 2064 being provided between the resistance layers 2066 provided in the both end sections of the pressure roller 2063, the lubricating agent can be more stably applied to the inner peripheral surface of the belt 62 compared to in a configuration where the porous layer 2064 is provided in the end sections of the pressure roller 2063.

By the porous layer 2065 whose proportion of volume occupied by pores of the layer overall is larger than that of the porous layer 2064 being provided between the porous layer 2064 and the resistance layer 2066, the lubricating agent flowing out in the axial direction from the porous layer 2064 can be effectively absorbed.

Since the porous layer 2064 has the width W1 which is greater than or equal to the width W2 of the pressure pad 69 in the axial direction, the lubricating agent can be supplied from the porous layer 2064 to the entire surface of the pressure pad 69 via the inner peripheral surface of the belt 62. As a result, sliding resistance can be reduced between the inner peripheral surface of the belt 62 and the pressure pad 69.

In the previously described second embodiment, the porous layer 2064 and the resistance layer 2066 having respectively differing thicknesses were provided on the outer peripheral surface of the roller section 2063A that has a uniform thickness T0 in the axial direction, and the surface of the porous layer 2064 was formed so as to be positioned more outwardly in the radial direction of the pressure roller 2063 than the surface of the resistance layer 2066. However, the present teaching is not limited to such a configuration, and, for example, it is also possible for the roller section 2063A to be configured in a crown shape that has a thickness of its central section in the axial direction thicker than a thickness of its both end sections in the axial direction, and for the thicknesses of the porous layer 2064 and the resistance layer 2066 to be made the same.

In the previously described second embodiment, the porosity of the porous layer 2065 is larger than the porosity of the porous layer 2064. However, the present teaching is not limited to such a configuration, and, for example, the porosity of the porous layer 2065 may be made smaller than the porosity of the porous layer 2064. In such a configuration, it becomes difficult for the lubricating agent to flow out from the porous layer 2064 into the porous layer 2065.

In the previously described second embodiment, the porous layer 2064, the porous layer 2065, and the resistance layer 2066 are provided in a state of being in contact with each other. However, the present teaching is not limited to such a configuration, and, for example, a slit may be provided between the porous layer 2065 and the resistance layer 2066.

In the previously described second embodiment, the resistance layer 2066 was a nonporous layer. However, the present teaching is not limited to such a configuration, and, for example, the resistance layer may be formed from a rubber sponge of an independent cell structure.

Moreover, assuming the resistance layer to be a two-layer structure configured from an inner layer and an outer layer, the inner layer may be formed by a porous layer similar to the porous layer 2064, and the outer layer contacting the inner peripheral surface of the belt 62 may be formed by a coating layer of silicone rubber. Furthermore, the inner layer may have on its end surface adjacent to the porous layer 2064 a coating layer having oil repellency for sealing the lubricating agent.

Next, modified modes of the second embodiment will be described. As depicted in the modified modes below, the pressure roller 2063 as a rotating member in the second embodiment may also be changed variously. Note that in the description below, configuring elements similar to those of the previously described embodiment will be referred to using the same symbols as those used in the previously described embodiment, and detailed descriptions thereof will be omitted.

Figure 7A:
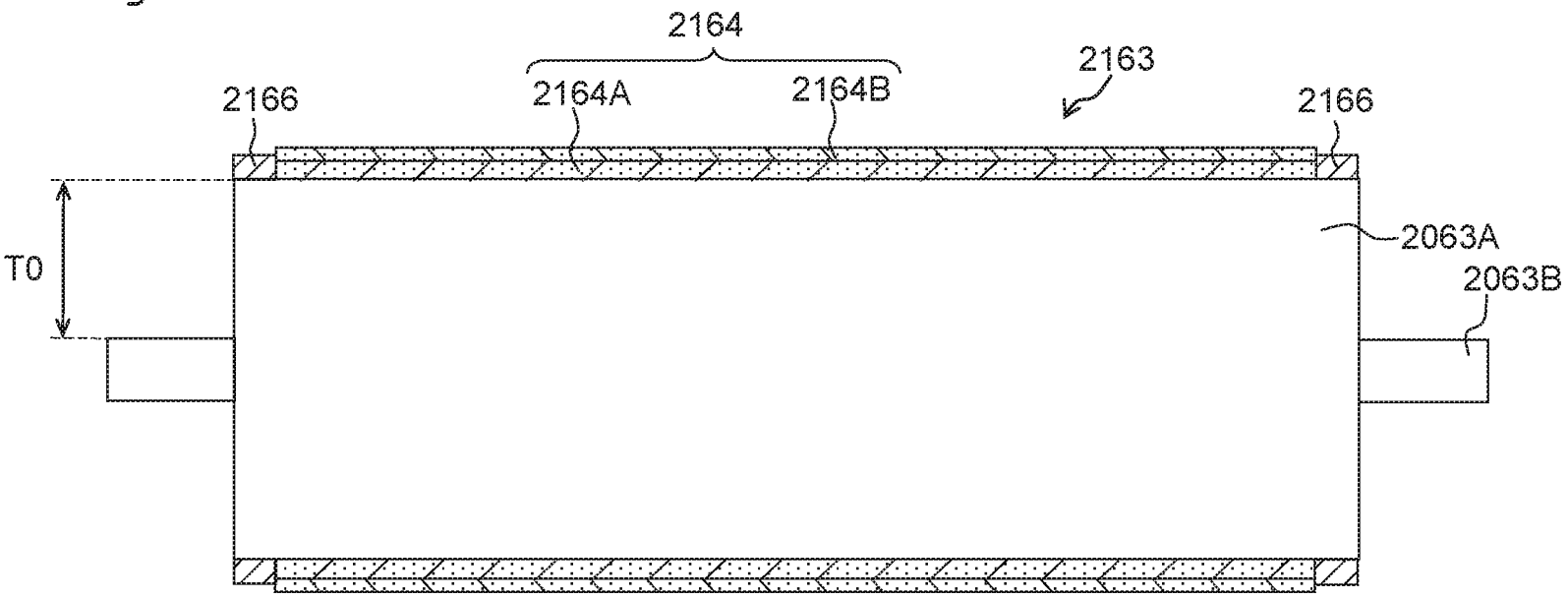
FIG. 7A is a cross-sectional view of a pressure roller according to a first modified embodiment of the second embodiment.
Figure 7B:
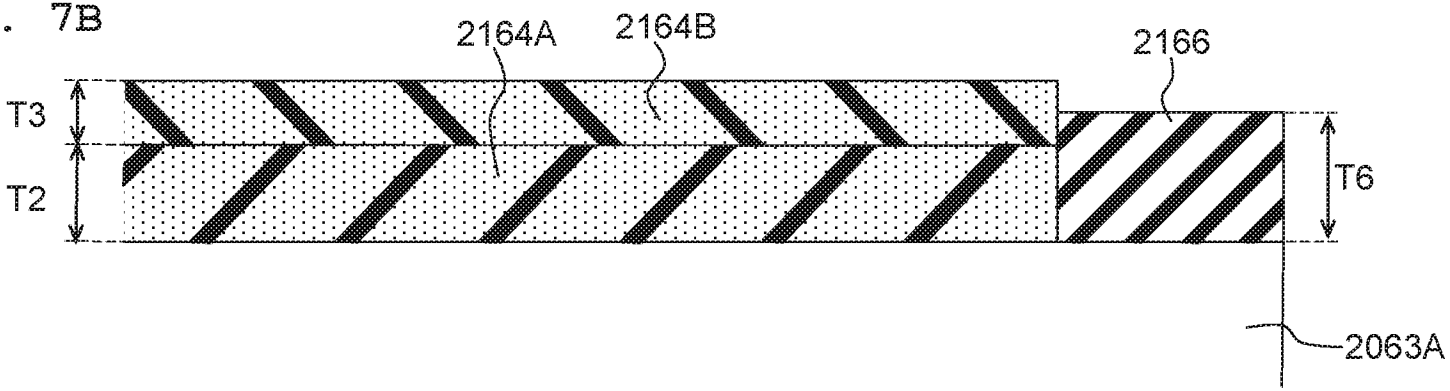
FIG. 7B is a partial enlarged view of a surface layer of the pressure roller of the first modified embodiment of the second embodiment.

As depicted in FIGS. 7A and 7B, in a pressure roller 2163 according to a first modified embodiment of the second embodiment, a porous layer 2164 and two resistance layers 2166 are provided on the outer peripheral surface of the roller section 2063A in a state of being in contact with each other.

The porous layer 2164 is provided between the resistance layers 2166 provided in both end sections of the pressure roller 2163, and has a two-layer structure configured from an inner layer 2164A and an outer layer 2164B.

The inner layer 2164A is a layer impregnated with the lubricating agent, and is configured by a heat-resistant resin appropriately selected from among similar resin materials to those of the previously described porous layer 2064 of the second embodiment (refer to FIGS. 6A and 6B).

The outer layer 2164B is a cylindrically shaped porous layer provided on an outer peripheral surface of the inner layer 2164A, and is configured by a heat-resistant resin appropriately selected from among similar resin materials to those of the porous layer 2064 depicted in FIGS. 6A and 6B.

The outer layer 2164B is a layer for adjusting an amount of the lubricating agent to be supplied from the inner layer 2164A to the inner peripheral surface of the belt 62, and then applying the adjusted amount of lubricating agent to the inner peripheral surface of the belt 62. Therefore, a porosity of the outer layer 2164B is configured to be smaller than a porosity of the inner layer 2164A. For example, a cell diameter of the pores is smaller and the number of pores is fewer in the outer layer 2164B than in the inner layer 2164A.

Moreover, a thickness T3 of the outer layer 2164B is configured to be thinner than a thickness T2 of the inner layer 2164A.

The resistance layer 2166 is configured by a similar material to that of the previously described resistance layer 2066 of the second embodiment.

Moreover, a thickness T6 of the resistance layer 2166 is configured thicker than the thickness T2 of the inner layer 2164A, and thinner than a thickness obtained by adding the thickness T2 of the inner layer 2164A and the thickness T3 of the outer layer 2164B.

The fuser according to the first modified embodiment of the second embodiment allows the following advantages to be obtained.

By the porous layer 2164 having the inner layer 2164A which is impregnated with the lubricating agent and the outer layer 2164B whose proportion of volume occupied by pores of the layer overall is smaller than that of the inner layer 2164A, the lubricating agent impregnated in the inner layer 2164A can be applied while a supplied amount of the lubricating agent is adjusted via the outer layer 2164B, hence the lubricating agent can be stably applied to the inner peripheral surface of the belt 62.

Moreover, even if, for example, more of the lubricating agent is impregnated in the inner layer 2164A than in the previously described porous layer 2064 of the second embodiment, the supplied amount of the lubricating agent can be adjusted by the outer layer 2164B, hence it can be suppressed that the lubricating agent flows to a surface of the resistance layer 2166.

Note that it is also possible for the first modified embodiment and the previously described second embodiment to be combined, whereby the porous layer 2065 is provided between the porous layer 2164 configured from the inner layer 2164A and outer layer 2164B and the resistance layer 2166.

In such a pressure roller, it is desirable for silicone oil to be used as the lubricating agent and for the first porous layer and the second porous layer to be configured by a material configured from a fluorine-based resin (PTFE, PFA, FEP, EEFT).

In such a configuration, by employing in the first porous layer and the second porous layer a fluorine-based resin excelling in wear resistance, durability of a portion making sliding contact with the inner peripheral surface of the belt 62 can be increased, and by providing the second porous layer, it can be made more difficult for the lubricating agent to adhere to the resistance layer which is configured from silicone rubber.

Figure 8A:
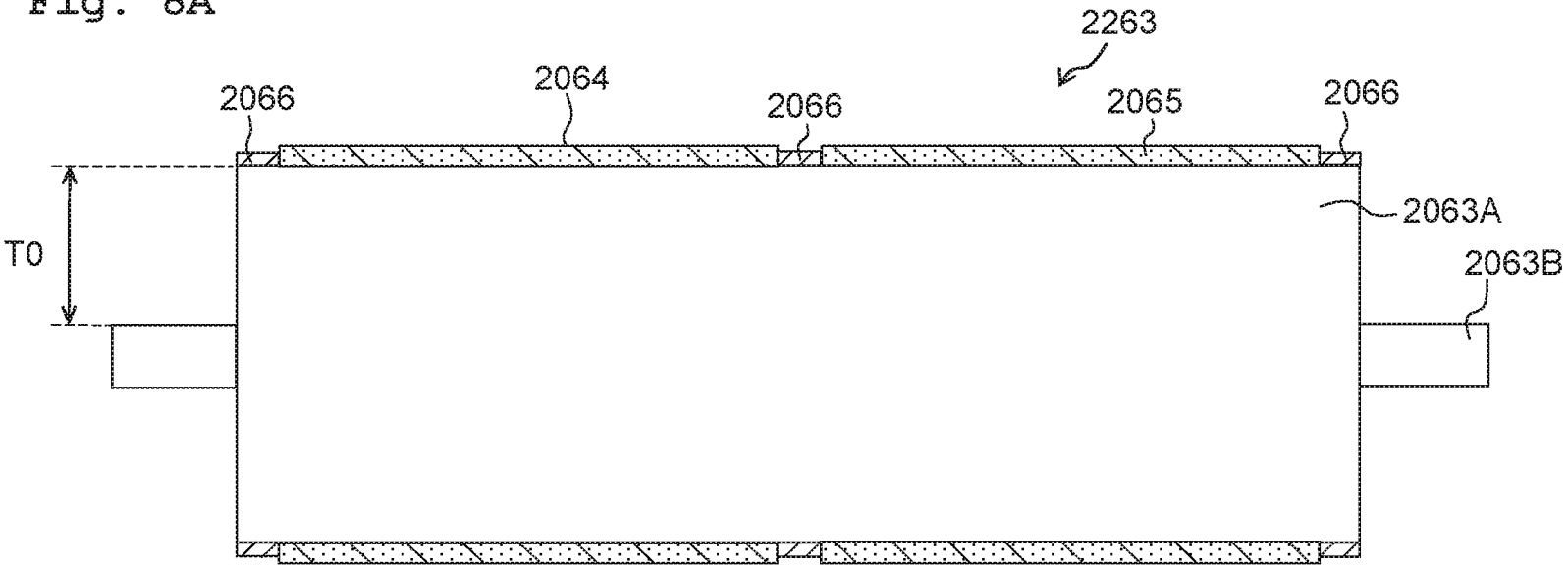
FIG. 8A is a cross-sectional view of a pressure roller according to a second modified embodiment of the second embodiment.
Figure 8B:
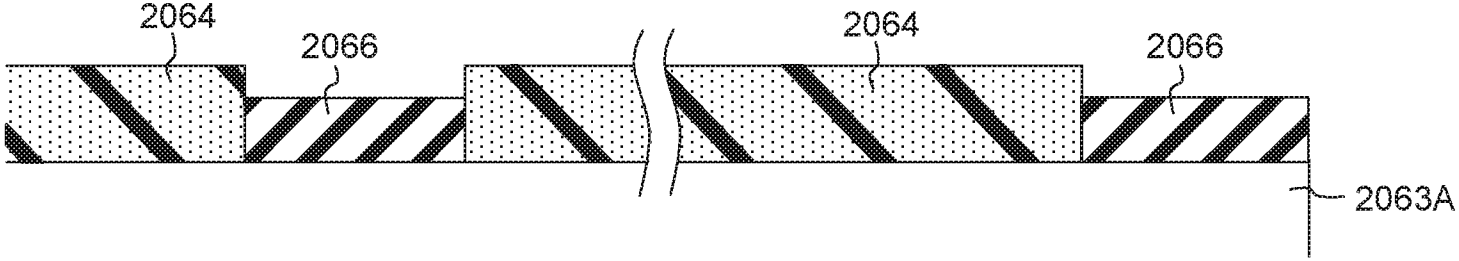
FIG. 8B is a partial enlarged view of a surface layer of the pressure roller of the second modified embodiment of the second embodiment.

As depicted in FIGS. 8A and 8B, in a pressure roller 2263 according to a second modified embodiment of the second embodiment, two porous layers 2264 (first porous layers) impregnated with the lubricating agent and three resistance layers 2266 are provided on the outer peripheral surface of the roller section 2063A in a state of being in contact with each other.

The resistance layers 2266 are provided in a central section and both end sections in the axial direction of the roller section 2263A, and the two porous layers 2264 are respectively provided between the three resistance layers 2266.

Due to the pressure roller 2263 configured in this way, the resistance layers 2266 are provided in the central section and both end sections in the axial direction of the roller section 2263A, hence a surface area contacting the inner peripheral surface of the belt 62 increases and the belt 62 can be more stably rotated.

In the previously described second embodiment and each of the modified modes, the first porous layer was provided on the outer peripheral surface of the roller section 2063A. However, the present teaching is not limited to such a configuration, and, for example, it is also possible for a first porous section of similar configuration to the first porous layer to be directly provided, as a roller section, on the outer peripheral surface of the rotating shaft 2063B. Similarly, it is also possible for a second porous section and a resistance section of similar configurations to the second porous layer and the resistance layer to be directly provided on the outer peripheral surface of the rotating shaft 63B.

In the previously described second embodiment and each of the modified modes, it is desirable that the lubricating agent used is appropriately selected to match selection of the material of the sliding-contact member in addition to selection of the materials configuring each of the members of the pressure roller.

In the previously described second embodiment and each of the modified modes, the resistance layer is provided in both end sections of the pressure roller, but it is also possible for the first porous layer to be provided in both end sections of the pressure roller.

That concludes description of the embodiments of the present teaching. However, the present teaching is not limited to the previously described embodiments, and specific configurations may be appropriately changed in a range not departing from the spirit of the present teaching.

Each of the previously described embodiments and modified modes included the belt 62, the heating roller 61 as the contacting member, the pressure roller 63, 163, 263, 2063, 2163, 2263 as the rotating member, and the belt guide 68 and pressure pad 69 as the sliding-contact member, and adopted the pressure belt system fuser 6 in which the belt 62 was wound around the pressure roller 63, 163, 263, 2063, 2163, 2263, the belt guide 68, and the pressure pad 69. However, the present teaching is not limited to such a configuration.

For example, it is also possible to adopt a configuration in which a heating belt wound on the heating roller is adopted, and the contacting member is configured as the heating belt.

Moreover, it is also possible to adopt a configuration in which a heat source, a first pressure roller, and a guide that makes sliding contact with an inner peripheral surface of an endless belt are disposed on an inner side of the belt, and a second pressure roller is disposed in a position opposing the first pressure roller sandwiching the belt. In this case, the first pressure roller corresponds to the rotating member, the second pressure roller corresponds to the contacting member, and the guide corresponds to the sliding-contact member.

Each of the previously described embodiments and modified modes adopted a configuration in which the drive power was transmitted to the heating roller whereby the heating roller was rotated, and the belt and pressure roller were drawn round. However, the present teaching is not limited to such a configuration, and it is also possible to adopt a configuration in which the drive power is transmitted to the pressure roller, and the belt and heating roller are drawn round.

In each of the previously described embodiments and modified modes, the present teaching was applied to a laser printer. However, the present teaching is not limited to such a configuration, and the present teaching may be applied also to another image forming apparatus such as a copying machine or multifunction peripheral.

Moreover, it is also possible for each of the elements described in each of the previously described embodiments and modified modes to be implemented combined in any way.

What is claimed is:

1. A fuser comprising:

an endless belt;

a contacting member contacting an outer peripheral surface of the endless belt;

a pressure roller contacting an inner peripheral surface of the endless belt and sandwiching the endless belt together with the contacting member; and a sliding-contact member making sliding contact with the inner peripheral surface of the endless belt, wherein the pressure roller includes a first porous layer impregnated with a lubricating agent, in a place contacting the inner peripheral surface of the endless belt.

2. The fuser according to claim 1, wherein the pressure roller includes:

an elastic layer located more inwardly than the first porous layer in a radial direction of the pressure roller; and a first nonporous layer located between the first porous layer and the elastic layer in the radial direction.

3. The fuser according to claim 2, wherein a width of the first nonporous layer is larger than a width of the first porous layer, in an axial direction of the pressure roller.

4. The fuser according to claim 2, further comprising a second nonporous layer located on both sides of the first porous layer, in an axial direction of the pressure roller.

5. The fuser according to claim 4, wherein at least part of a surface of the first porous layer is positioned more outwardly in the radial direction than a surface of the second nonporous layer.

6. The fuser according to claim 4, wherein the first porous layer and the second nonporous layer are separated from each other, in the axial direction.

7. The fuser according to claim 2, wherein a central portion of the first porous layer in an axial direction of the pressure roller is positioned more outwardly in the radial direction than both end portions of the first porous layer in the axial direction of the pressure roller.

8. The fuser according to claim 2, wherein a maximum thickness of the first nonporous layer is thinner than a maximum thickness of the first porous layer.

9. The fuser according to claim 2, wherein both end portions of the first nonporous layer are positioned more outwardly in the radial direction than a central portion of the first nonporous layer, in an axial direction of the pressure roller, wherein a thickness of the central portion of the first porous layer in the axial direction is thicker than a thickness of both end portions of the first porous layer, and wherein the both end portions of the first porous layer are positioned between the both end portions of the first nonporous layer.

10. The fuser according to claim 1, wherein the pressure roller includes a resistance layer contacting the inner peripheral surface of the endless belt, and wherein a coefficient of friction, with the inner peripheral surface of the endless belt, of the resistance layer is larger than a coefficient of friction, with the inner peripheral surface of the endless belt, of the first porous layer.

11. The fuser according to claim 10, wherein at least part of a surface of the first porous layer is positioned more outwardly in a radial direction of the pressure roller than a surface of the resistance layer.

12. The fuser according to claim 11, wherein a thickness of the resistance layer is thinner than a thickness of the first porous layer.

13. The fuser according to claim 10, wherein the resistance layer is located on both sides of the first porous layer, in an axial direction of the pressure roller.

14. The fuser according to claim 10, further comprising a second porous layer located between the first porous layer and the resistance layer, wherein a proportion of volume occupied by pores of the first porous layer is larger than a proportion of volume occupied by pores of the second porous layer.

15. The fuser according to claim 10, wherein the first porous layer includes:

an inner layer which is impregnated with the lubricating agent; and an outer layer which is positioned more outwardly than the inner layer in a radial direction of the pressure roller, wherein a proportion of volume occupied by pores of the outer layer is smaller than a proportion of volume occupied by pores of the inner layer, and wherein a thickness of the resistance layer is thicker than a thickness of the inner layer, and thinner than a thickness obtained by adding the thickness of the inner layer and a thickness of the outer layer.

16. The fuser according to claim 1, wherein the first porous layer includes:

an inner layer which is impregnated with the lubricating agent; and an outer layer which is positioned more outwardly than the inner layer in a radial direction of the pressure roller, wherein a proportion of volume occupied by pores of the outer layer is smaller than a proportion of volume occupied by pores of the inner layer.

17. The fuser according to claim 1, wherein a width of the first porous layer is greater than or equal to a width of the sliding-contact member, in an axial direction of the pressure roller.

18. The fuser according to claim 1, wherein the pressure roller includes:

a rotating shaft; and a roller section covering an outer periphery of the rotating shaft, and wherein the first porous layer is located on an outer peripheral surface of the roller section.

19. The fuser according to claim 1, wherein the contacting member is a heating roller including a heat source located in the heating roller.

20. The fuser according to claim 1, wherein the sliding-contact member is a pressure pad sandwiching the endless belt together with the contacting member.

21. A fuser comprising:

an endless belt;

an heating roller contacting an outer peripheral surface of the endless belt;

a pressure pad contacting the inner peripheral surface of the endless belt and sandwiching the endless belt together with the heating roller at a first position; and a pressure roller contacting an inner peripheral surface of the endless belt and sandwiching the endless belt together with the heating roller at a second position away from the first position, the pressure roller including:

a rotating shaft;

an elastic layer covering the rotating shaft; and a porous layer covering the elastic layer and contacting the inner peripheral surface of the endless belt, the porous layer being impregnated with a lubricating agent.

* * * * *